US009174278B2

(12) United States Patent
Shima et al.

(10) Patent No.: US 9,174,278 B2
(45) Date of Patent: Nov. 3, 2015

(54) SUBSTANTIALLY CYLINDRICAL POWDER COMPACT AND DIE ASSEMBLY FOR COMPACTING POWDER

(75) Inventors: Jiro Shima, Matsudo (JP); Kazunori Maekawa, Matsudo (JP)

(73) Assignee: Hitachi Powdered Metals Co., Ltd., Matsudo-shi (JP)

( * ) Notice: Subject to any disclaimer, the term of this patent is extended or adjusted under 35 U.S.C. 154(b) by 1024 days.

(21) Appl. No.: 13/318,389

(22) PCT Filed: May 12, 2010

(86) PCT No.: PCT/JP2010/058027
§ 371 (c)(1),
(2), (4) Date: Nov. 14, 2011

(87) PCT Pub. No.: WO2010/131672
PCT Pub. Date: Nov. 18, 2010

(65) Prior Publication Data

US 2012/0058340 A1 Mar. 8, 2012

(30) Foreign Application Priority Data

May 13, 2009 (JP) ..... 2009-116504

(51) Int. Cl.

| | |
|---|---|
| ***B22F 3/03*** | (2006.01) |
| ***B22F 5/10*** | (2006.01) |
| ***B30B 11/00*** | (2006.01) |
| ***B22F 5/12*** | (2006.01) |

(52) U.S. Cl.
CPC ... *B22F 5/12* (2013.01); *B22F 3/03* (2013.01); *B22F 5/10* (2013.01); *B30B 11/007* (2013.01); *B22F 2998/00* (2013.01); *Y10T 428/2976* (2015.01)

(58) Field of Classification Search
USPC ..... 428/399; 425/78
See application file for complete search history.

(56) References Cited

FOREIGN PATENT DOCUMENTS

| | | |
|---|---|---|
| JP | U-49-128805 | 6/1974 |
| JP | A-59-166601 | 9/1984 |
| JP | A-61-133302 | 6/1986 |
| JP | B2-03-013281 | 2/1991 |
| JP | A-03-238805 | 10/1991 |
| JP | A-08-333606 | 12/1996 |
| JP | A-2005-240060 | 9/2005 |

(Continued)

OTHER PUBLICATIONS

English translation of Muneda (JP S61-133302), prepared by FLS, Inc., Oct. 2014.*

(Continued)

*Primary Examiner* — Humera Sheikh
*Assistant Examiner* — Lucas Wang
(74) *Attorney, Agent, or Firm* — Oliff PLC

(57) ABSTRACT

The cross-sectional shape of a main part except for both end portions is generally divided into a lower arc surface extending along a base circle and an upper arc surface of which a top portion corresponds to the base circle. Side edge portions extending inward from the base circle are formed on both side surfaces of the upper arc surface. Curved edge portions which concavely curves upward from the side edge portions to end surfaces and continues to the end surfaces and chamfer portions extending from the end surfaces to the side surfaces which planes the edges and curves so that width thereof gradually narrows, are formed on both ends in a longitudinal direction.

8 Claims, 18 Drawing Sheets

(56) References Cited

FOREIGN PATENT DOCUMENTS

| | | |
|---|---|---|
| JP | A-2006-278499 | 10/2006 |
| JP | A-2008-153611 | 7/2008 |

OTHER PUBLICATIONS

International Search Report issued in International Patent Application No. PCT/JP2010/058027 dated Jul. 20, 2010.

* cited by examiner

SUBSTANTIALLY CYLINDRICAL POWDER COMPACT AND DIE ASSEMBLY FOR COMPACTING POWDER

TECHNICAL FIELD

The present invention relates to a sintered machine part produced by powder metallurgy in which raw material mainly consisting of metal powder is filled in a die hole and is compressed by an upper punch and a lower punch, and a compact is compacted (the so-called "pressing method"). In particular, it relates to a substantially cylindrical compact in which a cross sectional shape is substantially circular, and a die assembly which can compact such a compact at high density.

BACKGROUND ART

Since the above production method of the sintered machine part by powder metallurgy is characterized in that (1) a near-net shape can be formed, (2) it is suitable for mass production, (3) special materials, which cannot be made of ingot material, can be produced, or the like, it can be applied to machine parts for automobiles and machine parts for various industries.

As an example in which especially characteristic (3) of the above characteristics is utilized, a powder magnetic core used for an iron core such as an ignition coil, etc., may be mentioned (Patent Publications 1 to 3, etc.). Generally, the powder magnetic core is produced by forming an insulation coat on the surface of soft magnetic powder such as iron powder, compressing a mixed powder in which a small amount of resin powder is added thereto, and carrying out heat treatment. Such a powder magnetic core has a characteristic in which eddy current loss is small, since eddy current generated arises during use is contained inside of the soft magnetic powder by an insulation coat and resin which covers the surface of the soft magnetic powder, because of a high specific resistance value.

A laminated silicon steel plate is used for the iron core, etc., so far. The laminated silicon steel plate is produced by stacking plural silicon steel plates inserting insulating firms between the silicon steel plates. The silicon steel plate contains silicon for improving electric resistance, and has a isotropic crystal direction which is easily magnetized by arranging to a rolling direction. Therefore, the laminated silicon steel plate has a high specific resistance value and small eddy current loss, and is widely used as an iron core. However, since the silicon steel plate is hard and is poor in formability, a target shape is stacked by laminating silicon steel plates blanked as a piece. Therefore, the laminated silicon steel plate has a problem in that efficiency of productivity is low. With regard to this point, since the powder magnetic core has the above characteristics (1) and (2), it is used instead of the laminated silicon steel plate.

The iron core for an ignition coil is inserted into a primary coil and a secondary coil. It is known that magnetic property is maximally exhibited when there is no gap between these coils and the iron core. Therefore, the most suitable shape of the iron core is a simple cylinder in which a cross section is circular having an outer diameter in proportion to an inner diameter of the coil.

In the case in which the raw material powder is compressed into the simple cylinder, as shown in FIG. 19A, generally a method described below is used. That is, a suitable amount of the raw material powder is filled in a cavity formed by the die hole 21 formed in a die 2 which extends in a longitudinal direction and the lower punch 4 slidably inserted from below into this die hole 21. Here, the cavity is formed an upper portion of a die hole 21 than a lower punch 4. Next, an upper punch 3 slidably inserted into the die hole 21 is inserted from above. And the raw material powder is compressed by the upper punch 3 and the lower punch 4. According to this method, an end surface 10 is formed by the upper punch 3 and the lower punch 4, as shown in FIG. 19B, and the compact 1 in which side surfaces extending to an axial direction are formed by an inner surface of the die hole 21 of the die 2 can be produced. That is, this compressing method is a method which compresses the powder in an axial direction of the compact in order to form the cylindrical compact.

However, when this method is used, a phenomenon in which density of an upper end portion and a lower end portion (both ends in an axial direction) in the compact 1 is higher than the density of a center portion b and the density of the center portion b is decreased, that is, a so-called neutral zone is generated at a center portion in a compressing direction. The neutral zone is generated due to the following reason. The powder compressed by the upper punch 3 and the lower punch 4 is rearranged by sliding at a powder surface due to pressure, and is refined by plastically deforming. However, pressure applied by the upper punch 3 and the lower punch 4 is transmitted from an end portion a to a center portion b, while being consumed by rearrangement and plastic deformation. Therefore, pressure applied to the raw material powder decays, as distance between the compact 1 and the end surface 10 is increased.

In the case in which length of the compact in a compressing direction to a compressed surface is long, generation of the neutral zone is not avoided, and it is difficult to eliminate the neutral zone, even if the pressure applied by the upper punch and the lower punch is increased. In the above powder magnetic core for an iron core, when a neutral zone having low density is generated, magnetic properties are deteriorated depending on the generation, since in particular, magnetic flux density is proportional to space factor of the soft magnetic powder.

Therefore, when a substantially cylindrical compact which is long in an axial direction is compressed, a method in which powder is compressed in a radial direction crossing an axial direction of the compact at right angles, is proposed (Patent Publications 4 and 5, etc.). The publications describe that according to this method, distance in a compressing direction is short, and an entire side surface is pressed by the upper punch and the lower punch. Therefore, a compact in which the neutral zone is not generated, density is uniform in a longitudinal direction and is high, can be produced.

Patent Publication 1 is Japanese Unexamined Patent Application Publication No. H03-238805.

Patent Publication 2 is Japanese Unexamined Patent Application Publication No. 2006-278499 (claim 8).

Patent Publication 3 is Japanese Unexamined Patent Application Publication No. 2008453611.

Patent Publication 4 is Japanese Patent Publication No. H03-013281.

Patent Publication 5 is Japanese Examined Patent Application Publication No. 2005-240060.

DISCLOSURE OF THE INVENTION

Problems Solved by the Invention

In the compressing method described in the above patent publications 4 and 5, as shown in FIG. 20A, the powder is filled and compressed between punch surfaces 31,42 formed by the upper punch 3 and the lower punch 4 which are slidably inserted into the die hole 21 of the die 2. The punch surface 31, 42 have a cross section of semicircular arc shape which are symmetrical in a vertical direction. As a result, a cylindrical compact 1 in which an upper arc surface 11 and a lower arc surface 12 are formed, as shown in FIGS. 20B and 20C, can be produced. However, the upper punch 3 and the lower punch 4 used in this method have a problem in that they are easily damaged, since walls on both surfaces in a width direction which face each other in compression are thin.

In order to overcome this problem, flat portions 33,43 having a given width is provided, so as to improve both surface portions in a width direction that are thin. In addition, in order to prevent these flat portions 33,43 from damage due to contact with each other, the flat portions 33,43 are separated to some extent even in a condition in which powder is completely compressed. Therefore, a flange portion 13 (shaded area in FIG. 20C), which extends in an axial direction of the compact formed by compressing of the powder, protrudes from side surfaces of the compact 1 between the flat portions 33,43. This flange portion 13 is removed by machining since it is unnecessary, and the compact 1 is processed so that a cross sectional shape is circular.

That is, in the compressing methods described in the above patent publications 4 and 5, since it is necessary to remove the flange portion 13 by machining, production cost is increased, and raw material to be removed is wasted. Therefore, it is considered that it is used for an iron core of an ignition coil, while the flange portion 13 is left. However, in this case, since the flange portion 13 protrudes from a side surface, a gap between the iron core and the coil is necessarily increased, and magnetic properties are deteriorated in proportion to the increase.

Therefore, an object of the present invention is to provide a substantially cylindrical powder compact in which machining is unnecessary and a cross section shape of the compact intact approximates a circle. Specifically, an object of the present invention is to provide a compact having a volume ratio to cylinder in which a target cross sectional shape is a circle (base circle) of 0.95 or more. In addition, another object of the present invention is to provide a die assembly which compacts the above powder compact having such shape.

Means for Solving the Problems

The substantially cylindrical powder compact of the present invention is a powder compact having a substantially cylindrical shape in which a cross sectional outer shape contacts with an inside of a base circle having a substantially circular shape in which a shaft center of the circular shape agrees with the center of the circle. The cross sectional outer shape is constructed by at least a pair of side edge portions, an upper arc surface and a lower arc surface. The side edge portions are formed on both sides which separate about 180° in a circumferential direction from each other and extend inside from the base circle. The upper arc surface connects between inside edges of these side edge portions and contacts with an inside of the base circle at at least a top portion. And the lower arc surface connects between outside edges of these side edge portions and contacts with an inside of the base circle at at least a bottom portion. The powder compact further includes a curved surface portion and a chamfer portion on both edges in a longitudinal direction of the powder compact. The curved surface portion is concavely curved from each the side edge portion to the end surface and continues to the end surfaces. The chamfer portion planes the edge and gradually narrows from each of the end surface to the side surface. Here, in the present invention, in the case in which each top portion of the cross sectional shape is located so that distance from the base circle is 0 to −0.5 mm, it is considered that the compact contacts with an inside of the base circle.

The powder compact of the present invention includes an aspect in which a side flat portion that continues perpendicularly to the side edge portion is formed on the side surface.

In addition, the powder compact of the present invention includes an aspect in which the lower arc surface in the cross sectional outside shape is formed by a center lower arc surface which agrees with the base circle, and side lower arc surfaces which are formed on both sides of the center lower arc surface by way of steps formed between the center lower arc surface and the side lower arc surface.

Additionally, the powder compact of the present invention includes an example in which a width of the side edge portion is 0.1 to 0.5 mm, the curved surface portion has at least an arc surface, an elliptical arc surface, a plane, or a combined surface of these surface, a length of the curved surface portion is 1 to 5 mm, a rising width from the side edge portion is 1 to 5 mm, a length of the chamfer portion is a length of the curved surface portion or more, and is longer by 2 mm or less than the length of the curved surface portion, and a projection image of the curved surface portion to the end surface does not protrude outside from the base circle.

Furthermore, the powder compact of the present invention includes an example in which height of the side flat portion is greater than 0 mm but is 2 mm or less, or an example in which width of the center lower arc surface is 40 to 80% of a diameter of the base circle and a height of the step is greater than 0 mm but is 1 mm or less.

The die assembly for compacting powder of the present invention in which the powder compact of the above present invention can be preferably produced, and in which a powder compact having substantially cylindrical shape is compressed in a direction crossing an axial direction at right angles. The die assembly for compacting powder includes a die, a lower punch and an upper punch. The die has a die hole penetrated in a vertical direction. The die hole has a plane view of substantially rectangular, and includes a step portion, a large width portion, a small width portion and a curved portion. The step portion is formed at an intermediate in a vertical direction, and a cross sectional shape thereof is a concave arc which approximates a base circle in which a shaft center of the compact agrees with the center of the circle. The large width portion is formed on an upside of the step portion, and dimension in a width direction thereof is relatively large. The small width portion is formed on a downside of the step portion, and dimension in a width direction thereof is smaller than that of the large width portion. And the curved portion is formed on both sides in a longitudinal direction, and width thereof gradually narrows as the end surface is closed. The lower punch is slidably inserted into the small width portion of the die hole, and a concave arc lower punch surface having a cross sectional shape in a width direction which approximates the base circle is formed on an upper end surface thereof. And the upper punch is slidably inserted into the large width portion of the die hole, and a concave arc upper punch surface having a cross sectional shape in a width direction which agrees or approximates the base circle is formed on a lower end surface thereof. The upper punch includes a flat portion, a curved surface, and a curved surface portion. The flat portion is formed on both end portions in a width direction of the lower end surface, and extends in a longitudinal direction crossing a vertical direction at right angles. The curved surface is formed on both end portions in a longitudinal direction, and height thereof is gradually decreased while curving from a lower end surface side between the flat portion and the end surface. The curved surface portion corresponds to the curved surface of the die.

Additionally, the die assembly of the present invention includes an aspect in which width of the flat portion is 0.1 to 0.5 mm, the curved surface has at least an arc surface, an elliptical arc surface, a plane, or a combined surface of these surface, length of the curved surface portion is 1 to 5 mm, rising width from the flat portion is 1 to 5 mm, length of the curved surface portion is length of the curved surface or more, and is longer by 2 mm or less than the length of the curved surface, and a projection image of the curved surface to the end surface does not protrude outside from the base circle.

According to the substantially cylindrical powder compact of the present invention, since volume ratio of a cross section shape of the compact intact to a cylinder in which a target cross sectional shape is a circle (base circle) is 0.95 or more, machining is unnecessary, and production cost is prevented from increasing, and there is no waste of material, and for example, in the case in which it is applied to a powder magnetic core used for an iron core of an ignition coil, a gap between a circular coil and the iron core is minimized, and therefore, magnetic properties of the iron core can be maximally exhibited.

BEST MODE FOR CARRYING OUT THE INVENTION

In the following, embodiments of the present invention will be explained with reference to the drawings.

[A] Experimentation for the Present Invention

First, the experimentation used to achieve this invention will be explained.

Figure 14:
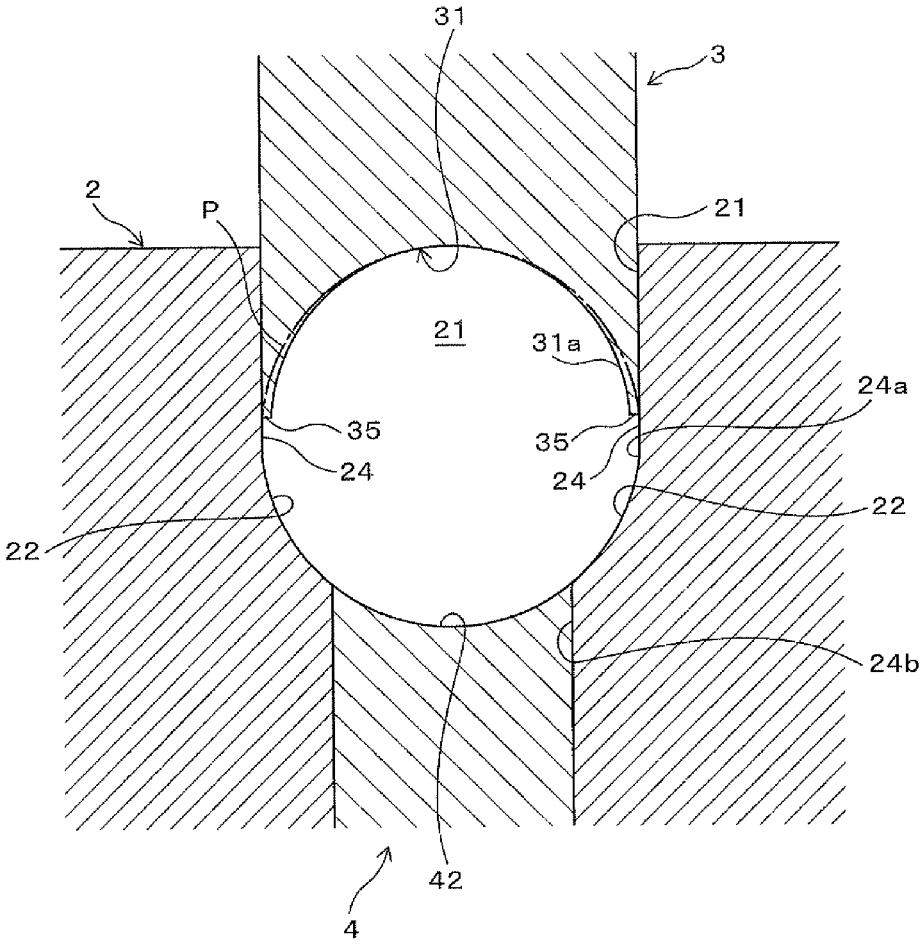
FIG. 14 is a cross sectional view showing a powder compressing state using a die assembly in the course of experimentation of the present invention.
Figure 15A:
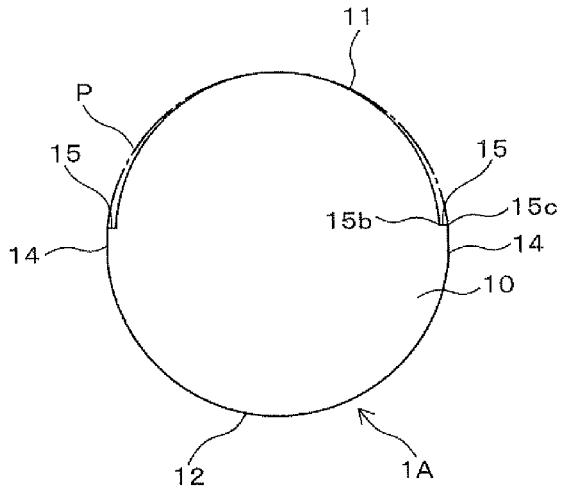
FIG. 15A is an end view showing a powder compact in the course of experimentation of the present invention.
Figure 15B:
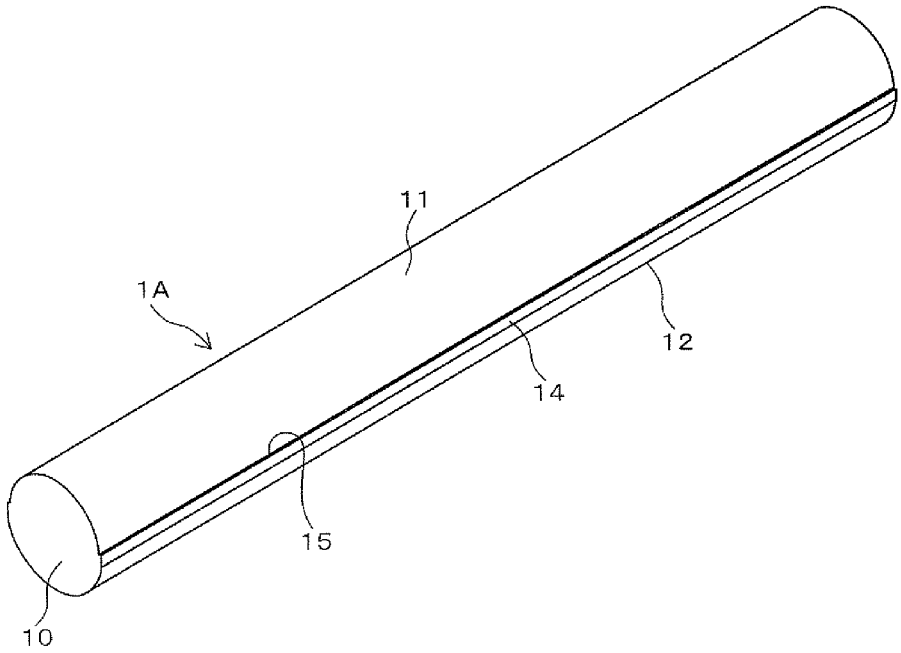
FIG. 15B is a perspective view thereof.

A powder die assembly first investigated is shown in FIG. 14, and powder compact 1A (in the following, it referred to as a "compact") produced by this die assembly is shown in FIG. 15. The die assembly shown in FIG. 14 includes die 2 with a step, an upper punch 3, and a lower punch 4. The die 2 has a die hole 21 which is penetrated in a vertical direction. A plane view of the die hole 21 is a rectangular shape corresponding to a longitudinal direction of the compact (extending in a front and back direction of the drawing in FIG. 14), and a step portion 22 which has left-right symmetry is formed at an intermediate portion. The step 22 is formed so that a cross section is a concave arc shape corresponding to a base circle P (a target circle). A large width portion 24*a* and a small width portion 24*b*, having a given width, are formed upward and downward of the step portion 22 in the die hole 21, respectively. Then, an upper punch 3 is slidably inserted from above to the large width portion 24*a*, and a lower punch 4 is slidably inserted from below to the small width portion 24*b*.

A lower punch surface 42 in which a cross section is a simple concave arc shape corresponding to the base circle P is formed on an upper surface of the lower punch 4. In compressing, the lower punch 4 is inserted into the small width portion 24*b* of the die hole 21 so that the lower punch surface 42 reaches a compressing position corresponding concentrically to the step portion 22.

An upper punch surface 31 in a concave arc shape that approximates the base circle P is formed on a lower surface of the upper punch 3. A flat portion 35 in which a longitudinal direction extends so as to cross with a vertical direction at right angles is formed at both side portions in a width direction of this upper punch surface 31. That is, the upper punch surface 31 is composed of a main upper punch arc surface 31*a* and the flat portion 35 which extends to both sides of the upper punch arc surface 31*a*. The flat portion 35 extends inside from the base circle P, and therefore, the upper punch arc surface 31*a* has a slightly smaller diameter than that of the base circle P. In compressing, the upper punch 3 is inserted into the large width portion 24*a* of the die hole 21, so as to have a flat surface 24 (a lower edge portion of the large width portion) between flat portions 38 at both sides and an upper edge of the step portion 22 and reaches a compressing position in which a top portion thereof overlaps with a top portion of the base circle P.

In order to obtain the compact by using the die assembly having the above composition, first the lower punch 4 inserted into the small width portion 24*b* of the die hole 21 of the die 2 is stopped at a slightly lower position than the above compressing position, and a suitable amount of raw material powder is filled in cavity of the die hole 21 opened upward. Next, the lower punch 4 is lifted to the above compressing position, the upper punch 3 is downwardly moved to the above compressing position, and the raw material powder is compressed by the upper punch 3 and the lower punch 4. After the compression, the upper punch 3 is upwardly removed, and the compact is ejected from the die by lifting the lower punch 4.

The compact 1A obtained by the above manner agrees with the base circle P, as described in FIG. 15, because the lower arc surface 12 is formed by a successive surface consisting of the step portions 22 on both sides of the die 2 and the lower punch surface 42 of the lower punch 4. In addition, a side flat portion 14 extending in a longitudinal direction is formed on a side surface of the compact 1A by the above flat surface 24. In this side flat portion 14, an outside edge 15*c* of a side edge 15 is an upper end, and a lower end is continued to the lower arc surface 12. Furthermore, an upper portion of the compact 1 has the above side edge 15 formed on both ends by the flat portions 35 of the upper punch 3 which separate each other about 180° in a circumferential direction, and an upper arc surface 11 formed by the upper punch arc surface 31 of the upper punch 3 which continues inside edges 15*b* of these side edges 15.

Figure 20A:
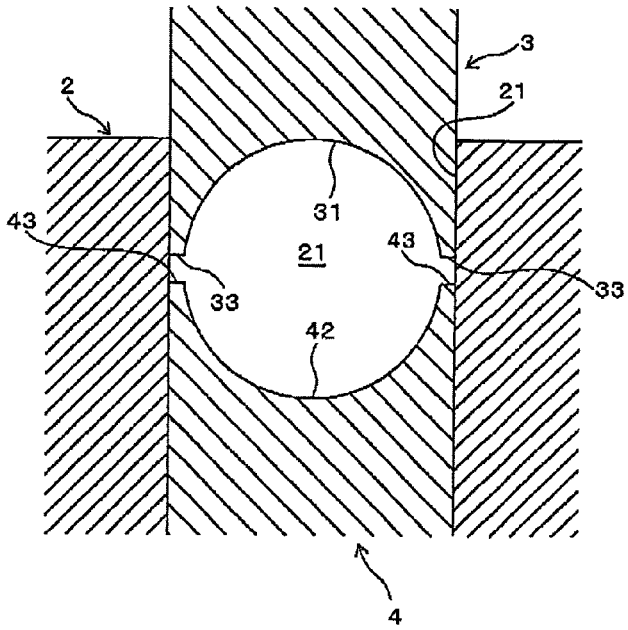
Fig. 20A Related Art
FIG. 20A is a cross sectional view showing a conventional well-known die assembly for compacting cylindrical powder compact.
Figure 20B:
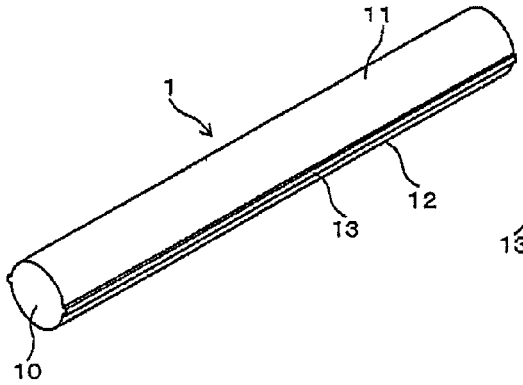
Fig. 20B Related Art
FIG. 20B is a perspective view showing a powder compact produced by the die assembly shown in FIG. 20A.
Figure 20C:
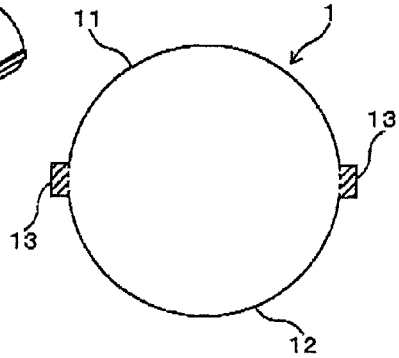
Fig. 20C Related Art
FIG. 20C is an end view showing a powder compact produced by the die assembly shown in FIG. 20A.

This compact 1A has the following advantages. First, since the side edges 15 extend to an inside of the base circle P, volume ratio of the compact 1A to a cylinder in which a cross section is the basic circle P is slightly decreased. However, a cross section of the compact 1A is approximate to the base circle P, that is, the volume ratio is high. Additionally, in the lower punch 4, it is not necessary to form the flat portions 43 on both sides as the lower punch 4 shown in FIG. 20A, since width thereof is considerably smaller than diameter of the compact 1A. In the contrast, in the upper punch 3, the flat portions 35 are necessary; however, by providing those portions inside of the base circle P, it is not necessary to form flange portions 13 protruded outside of the base circle P shown in FIG. 20, or the like, and it is also not necessary to perform machining for removing the flange portions 13.

Magnetic properties are improved in proportion to space factor of soft magnetic powder by a powder magnetic core for an iron core, and therefore, compacts having high density can be produced by increasing compacting pressure. When compressing is actually carried out by using the above die assembly in such circumstances, corners 39 (shown in FIG. 16) of the flat portions 35 of the upper punch 3 are chipped. This occurs by concentrating stress at the corners 39 under high load, since the flat portions 35 are extended straight in a longitudinal direction and are not supported from a width direction.

[B] First Embodiment of the Present Invention

The present invention has been made by considering the above experimentation, and in the following, a compact and a die assembly according to the first embodiment of the present invention will be explained.

Figure 1A:
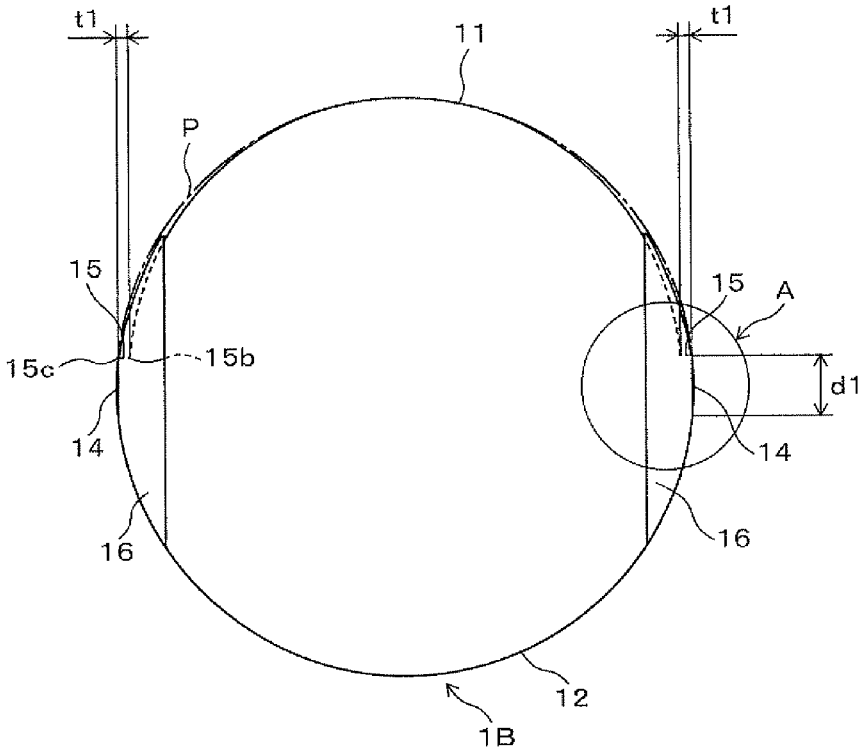
FIG. 1A is an end view showing a powder compact according to a first embodiment of the present invention.
Figure 1B:
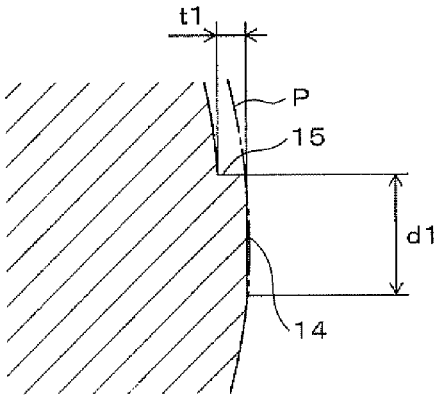
FIG. 1B is an enlarged view of part A in FIG. 1A.
Figure 2:
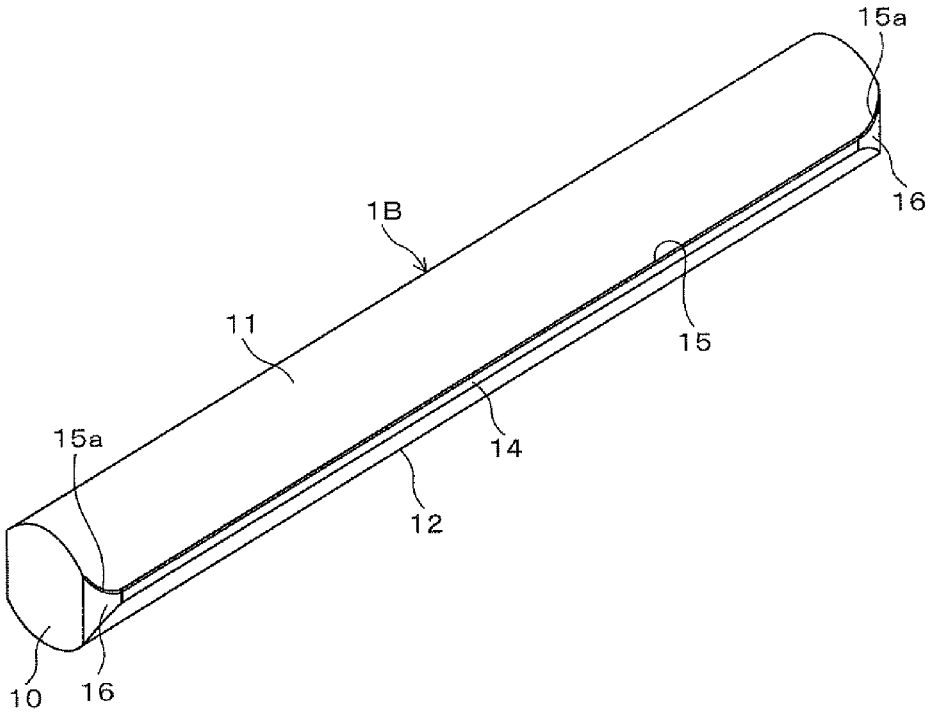
FIG. 2 is a perspective view showing a powder compact according to the first embodiment of the present invention.
Figure 3A:
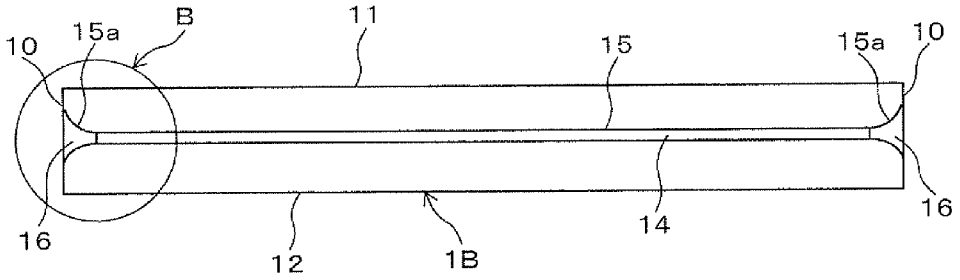
FIG. 3A is a side view showing a powder compact according to the first embodiment of the present invention.
Figure 3B:
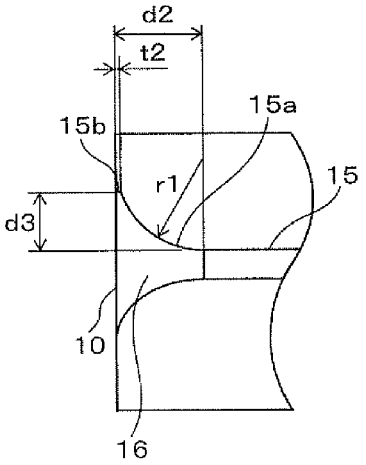
FIG. 3B is an enlarged view of part B in FIG. 3A.
Figure 4A:
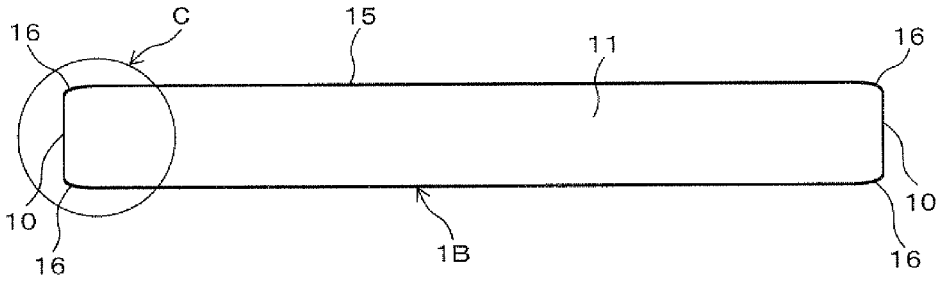
FIG. 4A is a plan view showing a powder compact according to the first embodiment of the present invention.
Figure 4B:
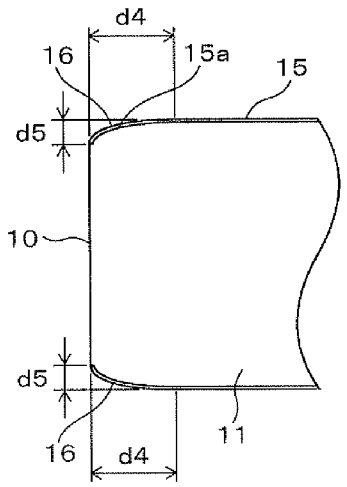
FIG. 4B is an enlarged view of part C in FIG. 4A.
Figure 5:
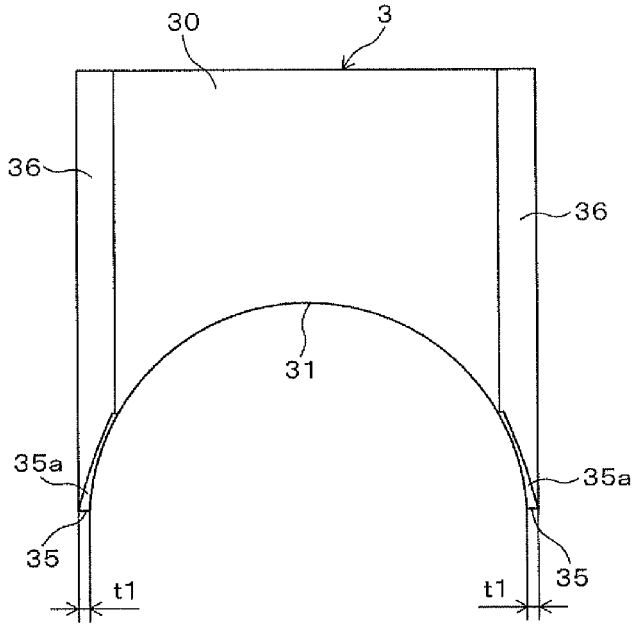
FIG. 5 is an end view showing a die assembly according to a first embodiment of the present invention.
Figure 6:
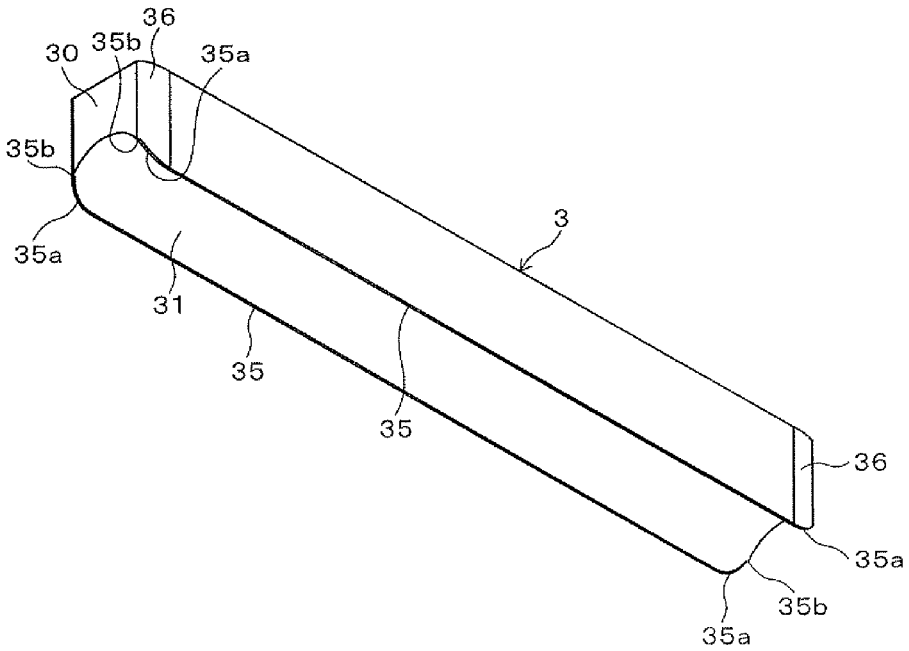
FIG. 6 is a perspective view showing an upper punch in the first embodiment of the present invention.
Figure 7A:
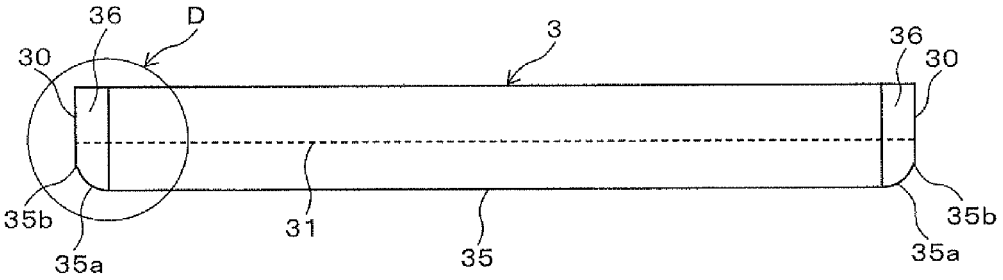
FIG. 7A is a side view showing an upper punch in the first embodiment.
Figure 8A:
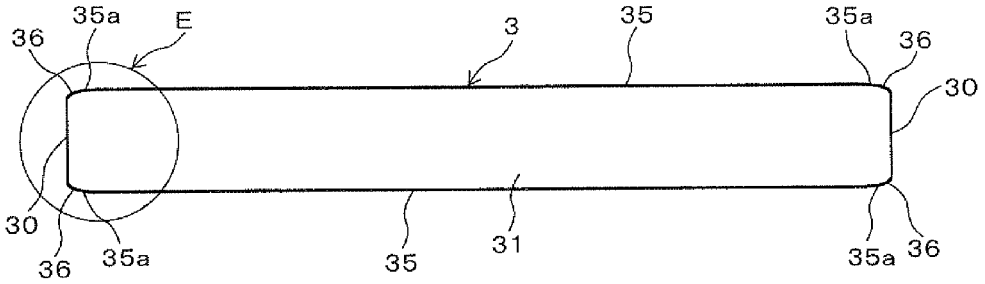
FIG. 8A is a plan view showing an upper punch in the first embodiment of the present invention.
Figure 8B:
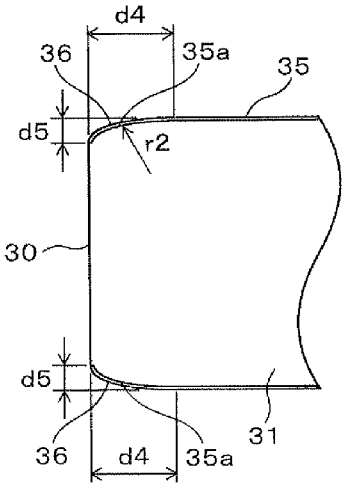
FIG. 8B is an enlarged view of part E in FIG. 8A.
Figure 9A:
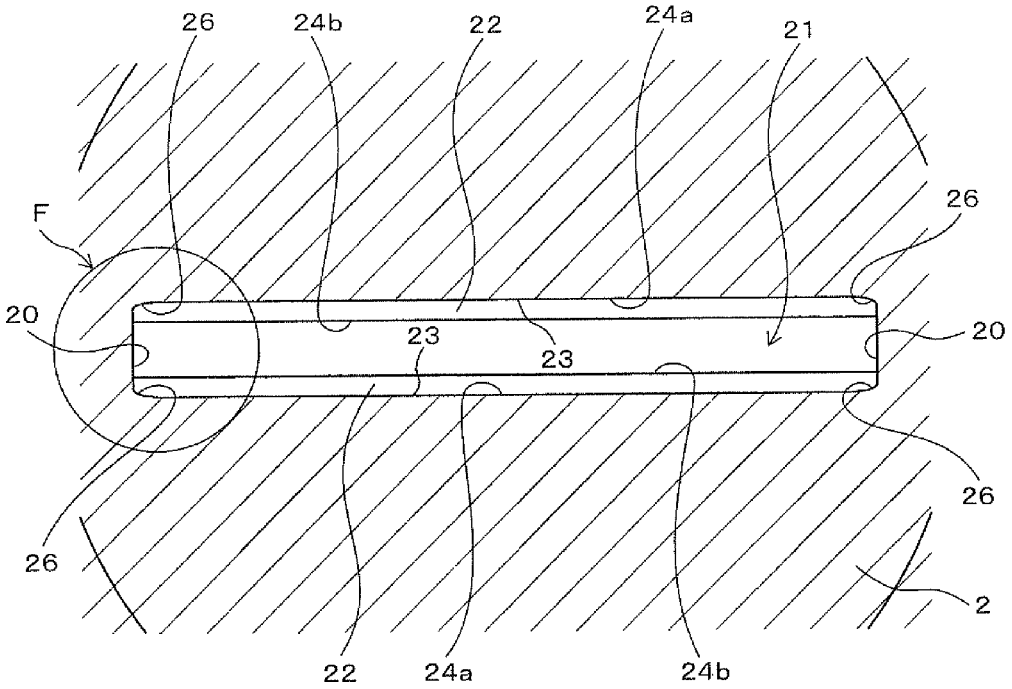
FIG. 9A is a plan view showing a die in the die assembly according to the first embodiment of the present invention.
Figure 9B:
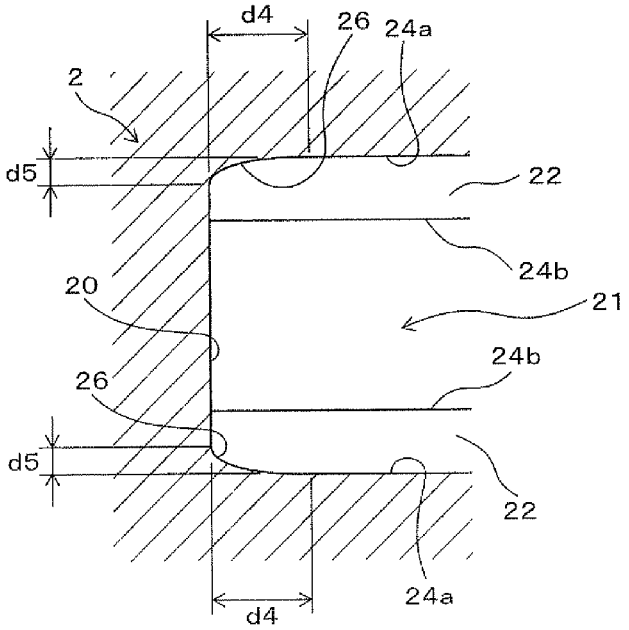
FIG. 9B is an enlarged view of part F in FIG. 9A.
Figure 10:
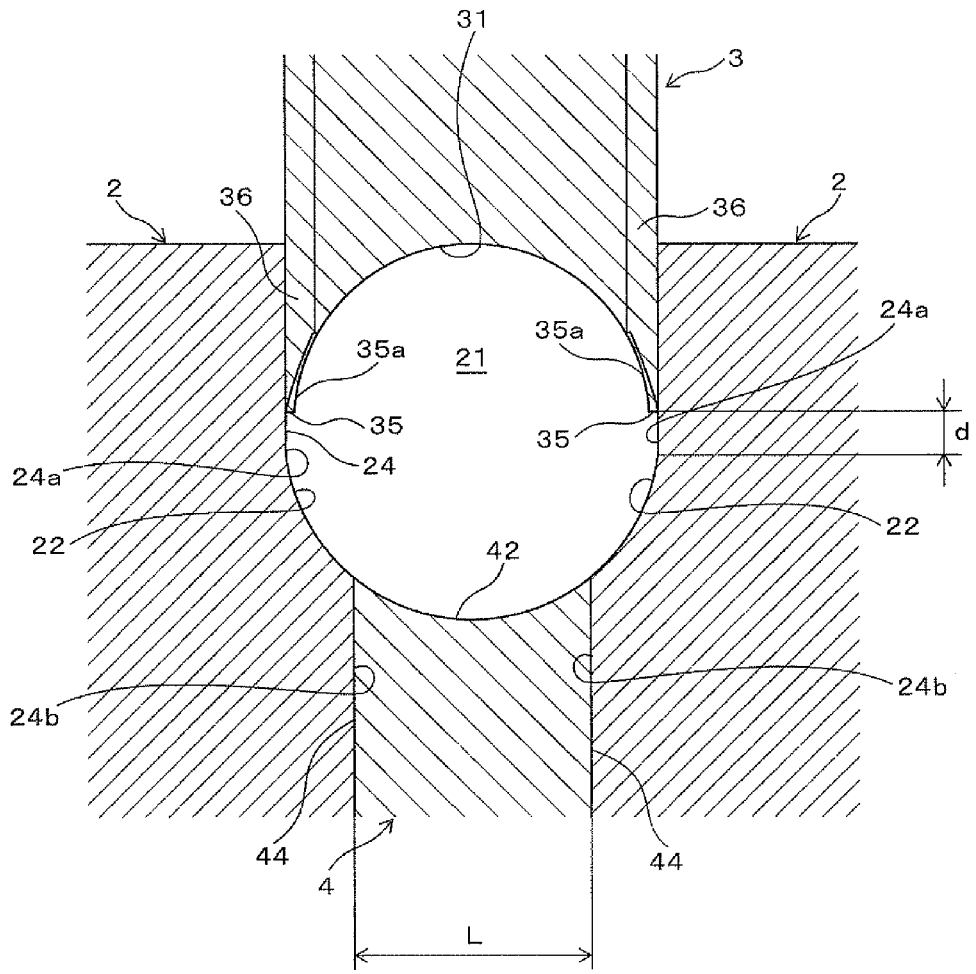
FIG. 10 is a cross sectional view showing a powder compressing state using the die assembly according to a first embodiment of the present invention.

FIGS. 1 to 4 show a compact 1B of the first embodiment, and FIG. 1 is an end view, FIG. 2 is a perspective view, FIG. 3 is a side view, and FIG. 4 is a top view. In addition, FIGS. 5 to 8 show a shape of an upper punch 3 in a die assembly of a first embodiment, and FIG. 5 is an end view, FIG. 6 is a perspective view, FIG. 7 is a side view, and FIG. 8 is a top view. Furthermore, FIG. 9 is a top view of a die in the die assembly, and FIG. 10 is a cross section view of the die assembly.

According to the compact 1B of the first embodiment, the problem in which the corners 39 in the upper punch 3 are chipped, found in the course of experimentation, is solved by removing the conventional flange portions 13 and by adding new improvement, based on the technical idea of the compact 1A in the above course of experimentation, the new improvement is added. That is, the follow matters are the same as those of the compact 1A of the above course of experimentation.

(1) The cross sectional shape of the compact contacts an inside of the base circle P, so that the shaft center agrees with the center of the base circle P.
(2) The side edges 15 which extend from the base circle P to the inside are formed on both sides of the compact.
(3) The upper arc surface 11 is formed between inside edges 15*b* of the side edges 15, and at least a top portion thereof contacts with the base circle P.
(4) The lower arc surface 12 is formed between outside edges 15*c* of the side edges 15, and at least a bottom portion thereof contacts with the base circle P.

Here, in the present invention, in the case in which each top portion of the cross sectional shape is located so that distance from the base circle is 0 to −0.5 mm, it is considered that the compact contacts with an inside of the base circle. That is, generation of dimensional error is unavoidable in industrial production; however, when the cross section protrudes from the base circle (that is, the distance is +), it can be received to a hollow portion of target coil, and in contrast, when the cross section is too small in comparison with the base circle, loss is increased by spreading a gap between the cross section and the base circle and magnetic properties are deteriorated by decreasing a volume of the magnetic core.

In the first embodiment, the following requirements are further added.

(5) The curved surface 15*a*, which is concavely continued to the end surface 10, is formed on both ends in a longitudinal direction of the compact, by concavely curving and rising from each side edge 15 to the end surface 10.
(6) The chamfer portion 16, which planes the edge and gradually narrows from each end surface 10 to the side surface, is formed on both ends in a longitudinal direction of the compact.

The above requirement (5) is a requirement for solving the problem in which the corners 39 of the upper punch 3 are chipped, and the curved surface 15*a* of the compact 1B is formed by a curved surface 35*a* (shown in FIGS. 5 to 8) formed on both ends in a longitudinal direction of the flat portions 35 in the upper punch 3. The curved surface 15*a* is formed in a convex shape, in which height is gradually decreased as curving from below between the side edge 15 and the end surface 10. Thus, the chip due to the concentration of stress can be effectively prevented by changing the corners 39 (see FIG. 16), in which the chip is easily generated by concentrating the stress, to the curved surface 35*a*, in which the stress is hardly concentrated.

Next, the above requirement (6) is necessary to make the shape of the end surface 10 in the compact 1B agree with the above requirement (1), in addition to the above requirement (5). The chamfer portion 16 of the compact 1B is formed by curved surface portion 26 of the die hole 21, as shown in FIG. 9. The curved surface portion 26 gradually narrows a width on both ends in a longitudinal direction of the die hole 21 of the die 2, and continues from the side surface 23 of the die hole 21 extending in a longitudinal direction to the end surface 20 on both ends in a longitudinal direction. In addition, as shown in FIGS. 5 and 6, in the upper punch 3, concave curved surfaces 36, which gradually narrow the width on both ends in a longitudinal direction of the upper punch 3, and continue to the end surface 30, are formed corresponding to the curved surface portions 26 of the die hole 21 of die 2. Whereby the upper punch 3 fits slidably into the die hole 21 of the die 2, and therefore, the compact 1B can be formed.

Figure 16:
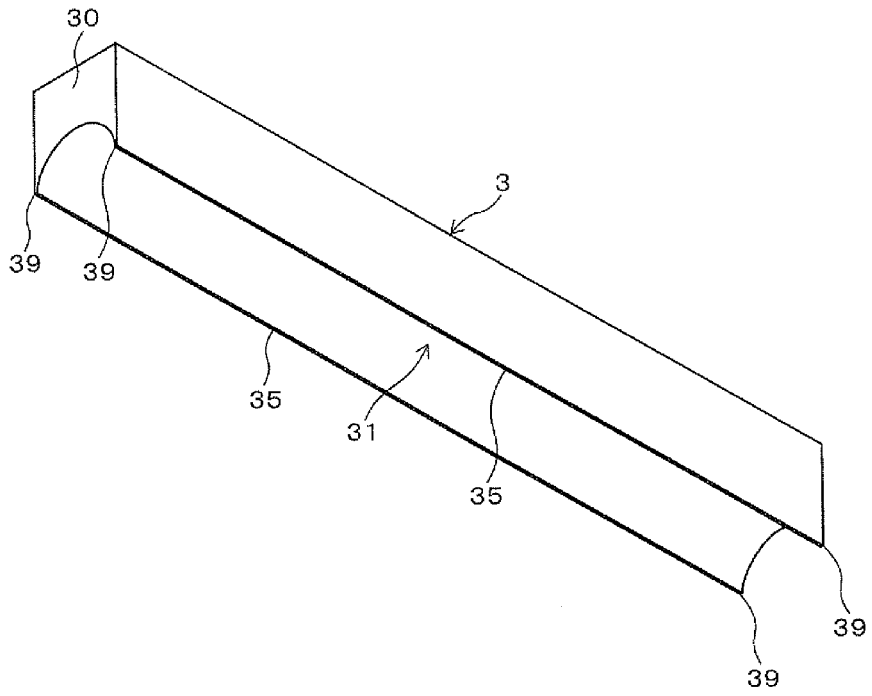
FIG. 16 is a perspective view showing an upper punch of the die assembly in the course of experimentation of the present invention.
Figure 17A:
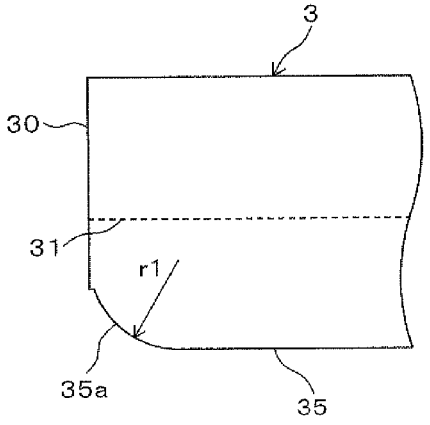
FIG. 17A is a side view showing an upper punch of a die assembly in a comparative example to the first embodiment of the present invention.
Figure 17B:
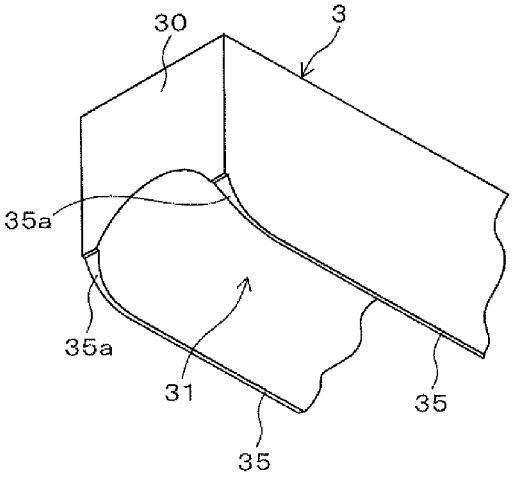
FIG. 17B is a perspective view thereof.
Figure 18A:
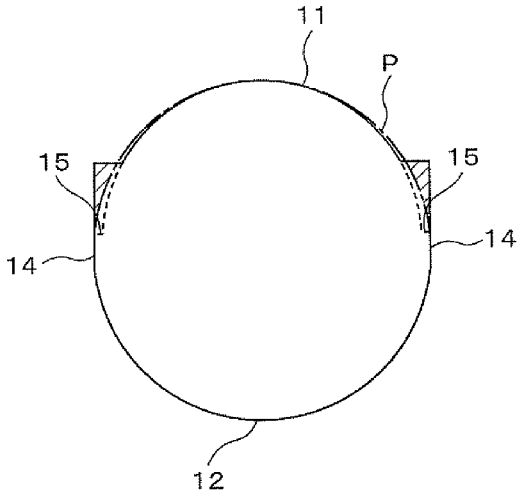
FIG. 18A is an end view showing a powder compact of the comparative example to the first embodiment of the present invention.
Figure 18B:
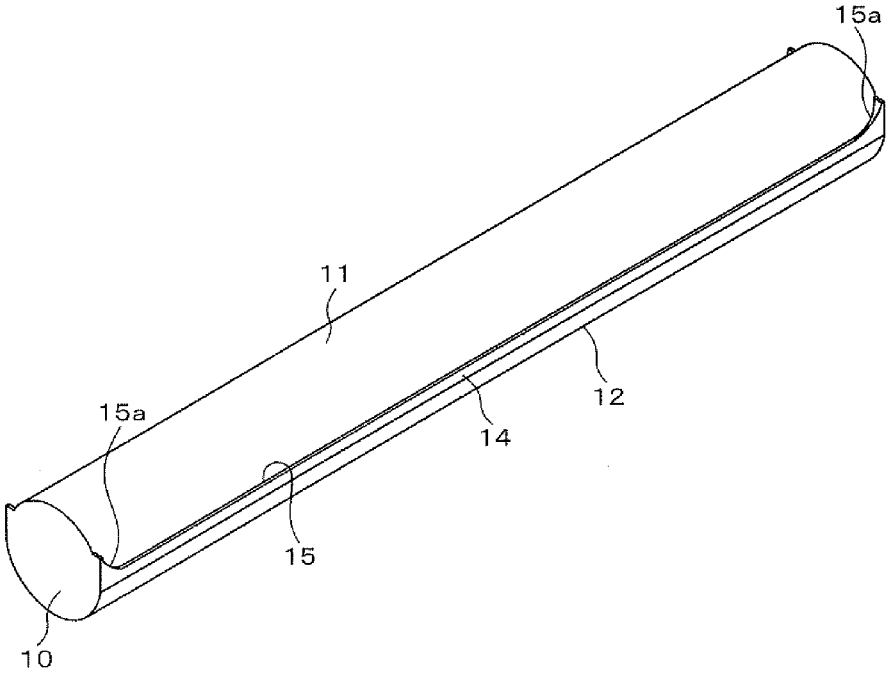
FIG. 18B is a perspective view thereof.
Figure 19A:
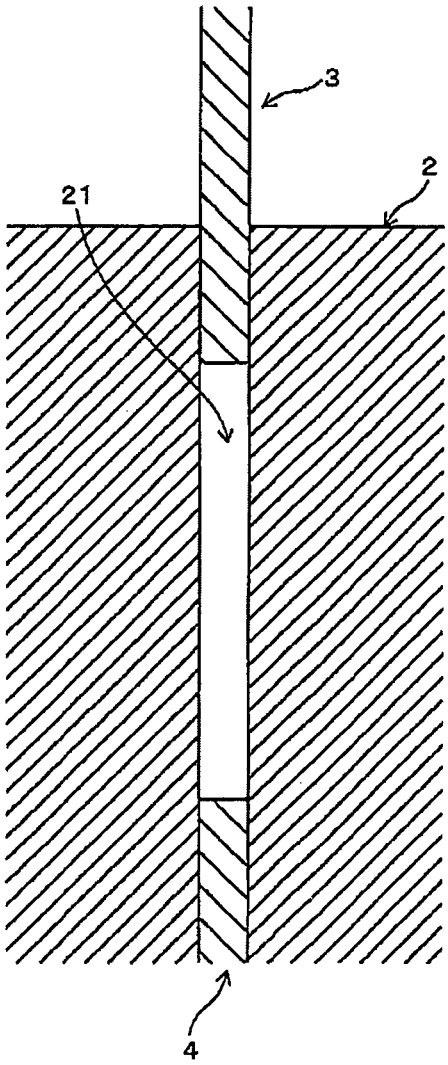
Fig. 19A Related Art
FIG. 19A is a cross sectional view showing a conventional well-known die assembly for compacting a cylindrical powder compact.
Figure 19B:
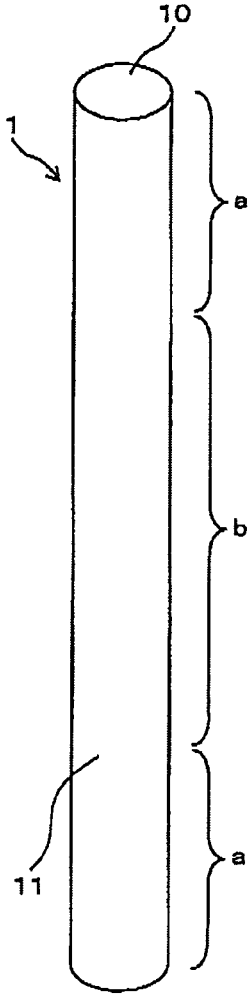
Fig. 19B Related Art
FIG. 19B is a perspective view showing a powder compact produced by the die assembly shown in FIG. 19B.

Moreover, in the case in which only the above requirement (5) is applied but the above requirement (6) is not applied, the problem about the chip of the upper punch 3 is solved, since in the upper punch 3, the corners 39 shown in FIG. 16 are formed to be the curved surface 35*a*, as shown in FIG. 17. In the case in which it is compacted using the upper punch 3 shown in FIG. 17, a curved surface portion 15*a* concavely bent which continues to the end surface 10 is formed at both ends of the compact, by curving and rising from the side edge 15 to the end surface 10, as shown in FIG. 18. However, parts (shaded areas in FIG. 18A) of the end surface 10 protrude outside of the base circle P by forming this curved surface 15*a*. The problem in the present invention still remains, since these protruded parts must be removed by machining, etc. Therefore, in the first embodiment, the above protruded parts are removed by forming the chamfer portion 16 of the above requirement (6).

The side edge 15 formed in the compact 1B of the above requirement (5) is formed by the flat portion 35 of the upper punch 3, and it is formed in order to prevent breaking the upper punch 3. From this point of view, it is preferable that width t of the side edge 15 (shown in FIG. 1), that is, width t1 of the flat portion 35 of the upper punch 3 (shown in FIG. 5) be 0.1 mm or more. However, when the width t1 of the edge 15 is increased, a cross section of the compact 1B to the base circle P is decreased in proportion to this increase. Therefore, the width t1 of the edge 15 is preferably 0.5 mm or less, and it is more preferably 0.3 mm or less.

Next, the curved surface 15*a* in the compact 1B of the above requirement (5) is formed by the curved surface 35*a* in the upper punch 3, in order to prevent chipping the corner 39 of the punch 3. In order to avoid the concentration of stress, it is preferable that this curved surface 35*a* of the upper punch 3 be shaped to be a concave arc surface or ellipse arc surface which continues to the flat portion 35 of the upper punch 3, and the curved surface 35*a* may be formed by smoothly continuing several arcs or elliptical arcs. Since the concentration of stress cannot be alleviated when the curved surface 35*a* in the upper punch 3 formed by arc having radius r1 is too short, as shown in FIG. 7, it is preferable the distance d2 from the end surface 30 of both ends in a longitudinal direction of the upper 3 and height d3 from the flat portion 35 of the upper punch 3 be 1 mm or more.

In addition, since distance of the chamfer portion 16 in the compact 1B d4 from the end surface 10 of the above requirement (6), is formed by corresponding to the curved surface 15*a* in the compact 1B, as shown in FIG. 3, when the distance d4 is too great, volume decreasing rate of the compact 1B is increased. Therefore, in the curved surface 35*a* of the upper punch 3 which forms the curved surface 15*a* of the compact 1B, it is preferable that distance d4 from the end surface 30 on both ends in a longitudinal direction of the upper punch 3 (shown in FIG. 8) and height d3 of the upper punch 3 from the flat portion 35 (shown in FIG. 7) be set to about 5 mm. That is, in the curved surface 15*a* in the compact 1B, it is preferable that distance d2 from the end surface 10 of the compact 1B and height d3 from the side edge portion 15 of the compact 1B be set to be 1 to 5 mm, and in the curved surface 35*a* of the upper punch 3, it is preferable that distance d2 from the end surface 30 of the upper punch 3 and height d3 from the upper punch 3 from the flat portion 35 be set to be 1 to 5 mm.

Figure 7B:
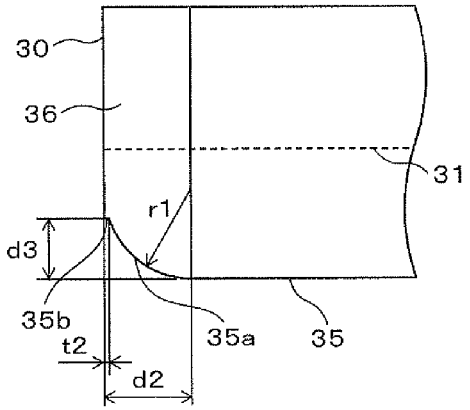
FIG. 7B is an enlarged view of part D in FIG. 7A.

Additionally, when the curved surface 35*a* of the upper punch 3 and the end surface 30 of the upper punch 3 are continued by an arc or an elliptical arc, raw material powder is hardly pressed near the end surface 30, and therefore, it is preferable that they be continued by a flat portion 35*b* which is parallel to the flat portion 35 and is relatively short, as shown in FIG. 7B. When distance t2 of this flat portion 35*b* from the end surface 30 in the upper punch 3 is too long, stress easily concentrates at a connected portion with the curved surface 35*a*. Therefore, distance t2 of the flat portion 35*b* from the end surface 30 in the upper punch 3 is preferably greater than 0 mm but is 0.5 mm or less, and it is more preferably 0.1 to 0.3 mm. A flat portion 15*b* having length t2 is formed between the end surface 10 and the curved surface 15*a* in the compact 1B, by this flat portion 35*b* in the upper punch 3, as shown in FIG. 3B.

Next, in order to prevent shape of the end surface 10 from protruding outside of the base circle P, the chamfer portion 16 of the above requirement (6) is formed by forming the curved surface 15*a* in the compact 1B, as described above. Thus, distance d4 of the chamfer portion 16 from the end surface 10 (shown in FIG. 4B) must be at least distance d2 of the curved surface 15*a* (shown in FIG. 2). If the distance d4 is too long, volume of the compact 1B is decreased in proportion to the distance. Therefore, it is preferable that the distance d4 be preferably longer by 2 mm or less than the distance d2, and it is more preferable that the distance d4 agree with the distance d2.

In addition, the curved surface 15*a* of the compact 1B is continued to the end surface 10 so that the height is gradually increased from the side edge 15. The ratio of protrusion of the curved surface 15*a* from the base circle P is decided in proportion to the height of the curved surface 15*a*. Therefore, decreased ratio d5 of a width of each portion in the chamfer portion 16 (shown in FIG. 4B) is decided in proportion to a changed ratio of height of the curved surface 15*a*, and it is set so that projection image of the curved surface 15*a* to the end surface 10 does not protrude outside from the base circle P.

The chamfer portion 16 of the compact 1B formed in the above manner is formed by a curved surface portion 26 of the die hole 21 in the die 2 and a curved surface portion 36 of the upper punch 3, and as a result, distance d4 of the curved surface portion 26 in the die 2 and the curved surface portion 36 of the upper punch 3, and decreased ratio d5 of these curved surface portions 26,36 (shown in FIGS. 8B and 9B) is decided in proportion to the above distance d4 from the end surface 10 of the compact 1 and the decreased ratio of width of the chamfer portion 16.

In the compact 1B of the present embodiment, the side edge 15 agrees with a horizontal surface which passes through the shaft center, and it is ideal when an upper arc surface 11 and a lower arc surface 13 are divided into equal parts by this horizontal surface. However, the flat portion 35 of the upper punch 3 is easily chipped, when the flat portion 35 of the upper punch 3 and the step portion 22 of the die 2 contact. Therefore, it is preferable that compressing be carried out while the flat portion 35 of the upper punch 3 and the step portion 22 of the die 2 are separated. In the case in which the compacting is carried out in the above manner, the above side flat portion 14 is formed in the compact 1B. However, this is unavoidable.

Moreover, it is necessary that this side flat portion 14 be located inside of the base circle P as a string of the base circle P, as shown in FIG. 1B. Therefore, width of the large width portion 24*a* of the die 2 is set to be slightly smaller than diameter of the base circle P. When height d1 of this side flat portion 14, that is, distance d1 between the flat portion 35 of the upper punch 3 and the large width portion 24*a* of the die 2 (shown in FIG. 10) is large, a cross section of the compact 1B to the base circle P is decreased in proportion to the height d1. Therefore, the height d1 of the side flat portion 14 is preferably greater than 0 mm but is 2 mm or less, and it is more preferably greater than 0 mm but 1 mm or less.

When width L of the lower punch 4 slidably inserted into the small width portion 24*b* of the die 2 (shown in FIG. 10) is increased, an angle of the lower punch surface 42 and the side surface 44 extending to a longitudinal direction is decreased and thickness is reduced, and therefore, there is a fear of damage to the lower punch 4. In contrast, when width L of the lower punch 4 is decreased, in order to fill a necessary amount of raw material powder for compressing, it is necessary to increase the depth of the cavity formed by the small width portion 24*b* of the die 2 and the lower punch surface 42, and it is necessary to increase the length of the lower punch 4. In addition, the raw material powder is pressed by the upper punch 3 and the lower punch 4; however, when an area of the lower punch surface 42 of the lower punch 4 is small, compressing pressure from the lower punch 4 is not sufficiently transmitted to the entirety of the raw material powder, and it is difficult for compressing to be suitably carried out on the entirety of the raw material powder. Furthermore, it is necessary to increase the compressing pressure of the lower punch 4, and there is a fear that the extended lower punch 4 may be broken. Therefore, it is preferable that the width L of the lower punch 4 be about 40 to 80% of the base circle P.

In the compact 1B of the above embodiment, for example, a volume of the compact 1B having a diameter of 10 mm, a total length of 80 mm, a height of the side flat portion of 1 mm, and a width of the side edge 15 of 0.2 mm, in which the curved surface portion 15*a* is formed by an arc having a radius of 3 mm, distance d2 of the curved surface portion 15*a* is 3 mm, and height d2 of the curved surface portion 15*a* is 2 mm, is 6192 $mm^3$. In contrast, a volume of a target cylinder having a diameter of 10 mm, a total length of 80 mm, in which cross section is the base circle P, is 6283 $mm^3$. Therefore, in the compact 1B of the present embodiment, a volume ratio to the target cylinder is 0.986 and is high.

[C] Second Embodiment of the Present Invention

Next, a second embodiment of the present invention, based on the above first embodiment, will be explained.

Figure 11:
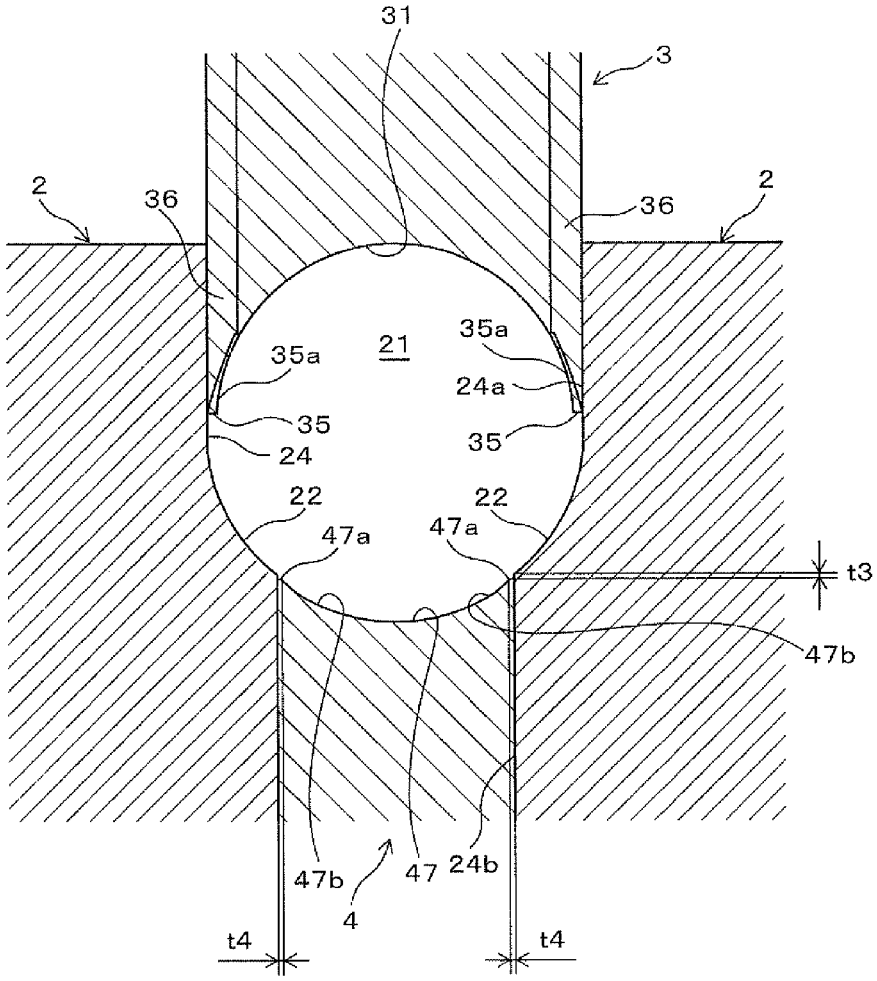
FIG. 11 is a cross sectional view showing a powder compressing state using the die assembly according to a second embodiment of the present invention.

In the compact 1B of the above first embodiment, a lower arc surface 12 is formed by a step portion 22 of die 2 and a lower punch surface 42 of a lower punch 4; however, in assembling a die assembly, it is difficult to make the step portion 22 and the lower punch surface 42 of the die 2 perfectly agree. Therefore, the die assembly may be assembled by changing a shape of the step portion 22 of the die 2 at a position which shifts to a small width portion 24*b* of a die hole 21, to an arc surface having a smaller diameter than that of the base circle P, as shown in FIG. 11, and by providing a step having a height t3.

When the die assembly is assembled in the above manner, error in assembling the die 2 and the lower punch 4 can be absorbed by a step t3, and it is easily assembled. However, when the step t3 is provided, volume of the compact is decreased in proportion to the step, and therefore, the step t3 is preferably greater than 0 mm but is 3 mm or less, and it is more preferably greater than 0 mm but is 0.5 mm or less.

In addition, the lower punch 4 is hardly damaged, since a corner portion formed by the lower punch surface 42 and the side surface 44 is not sharpen. However, when the compressing pressure is increased, there is fear that the chip occurs. Therefore, it is preferable that a plane 47*a* is provided in the corner portion, as shown in FIG. 11, and that the lower punch surface 42 be formed by an arc surface 47 which agrees with the base circle P (most of original lower punch surface 42), a plane 47*a* which contacts with the base circle P and shortly extends inside of the base circle P, a short plane 47*b* which continues the arc surface 47 and the plane 47*a*. However, width t4 of the plane 47*a* is preferably greater than 0 mm but is 0.5 mm or less and it is more preferable 0.1 to 0.3 mm, since when the plane 47*a* is provided, the volume of the compact is decreased in proportion to the plane.

Figure 12:
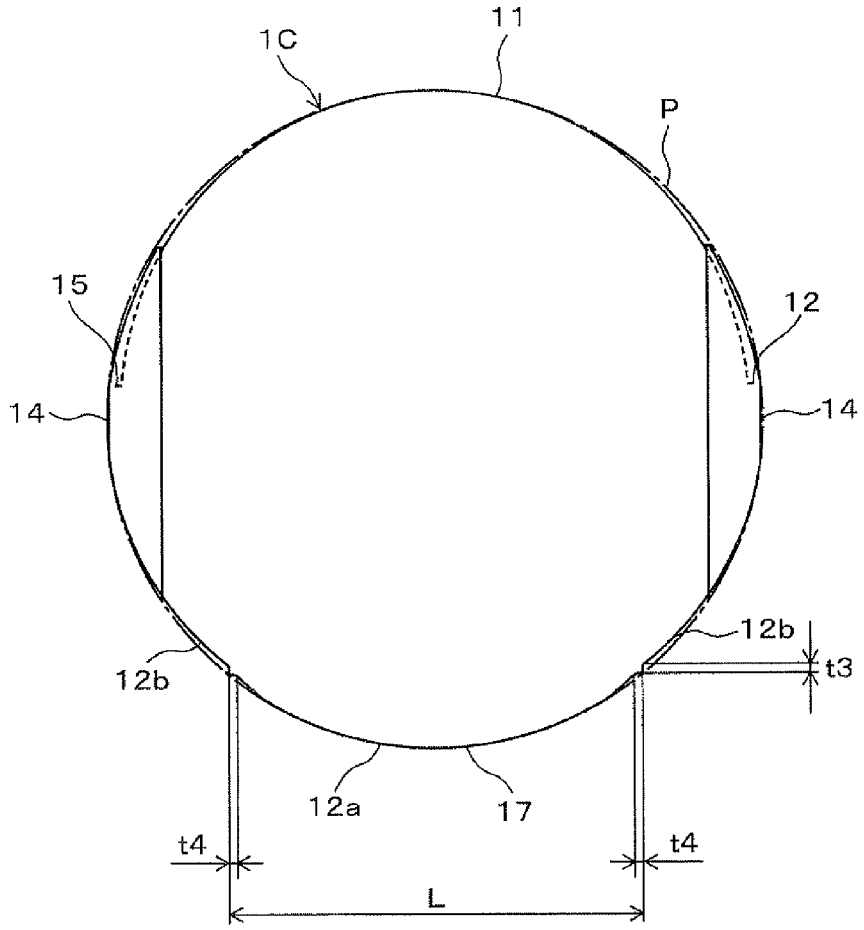
FIG. 12 is an end view showing a powder compact according to the second embodiment of the present invention.

FIG. 12 shows a compact 1C compacted by a die assembly which provides a step t3 between a die 2 and a lower punch 4, as described above and which provides a plane 47*a* having width t4 in the lower punch 4, and a step 17*a* is formed by the step t3. A lower arc surface 12 of this compact 1C is constructed by a center lower arc surface 12*a* between the steps 17*a*, and side lower arc surfaces 12*b* formed at both sides of the center lower arc surface 12*a* by way of the steps 17*a*. Here, volume of the compact 1 in the case in which condition of height t3 of the step 17*a* of 0.2 mm and width t4 of the plane 47*a* of 0.2 mm is added in the shape of the compact 1C of the second embodiment which calculates volume as described above, is 6146 $mm^3$, and volume ratio to volume (6283 $mm^3$) of a target cylinder is 0.978 and is high.

[D] Third Embodiment of the Present Invention

Next, a third embodiment of the present invention, based on the above first embodiment, will be explained.

Figure 13A:
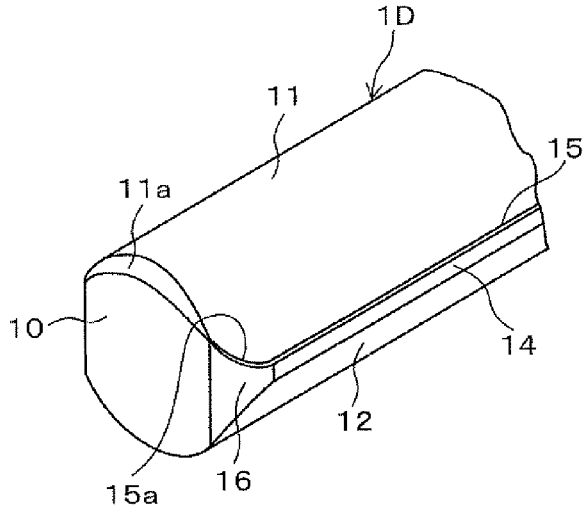
FIG. 13A is a perspective view showing an end portion of a powder compact according to a third embodiment of the present invention.
Figure 13B:
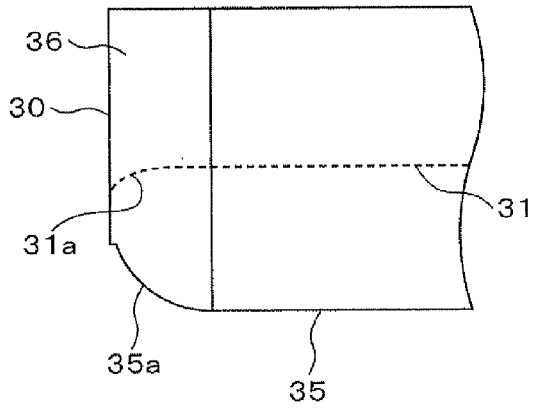
FIG. 13B is a side view showing an end portion of an upper punch in a die assembly in the third embodiment of the present invention.

In the compact 1 of the first embodiment, when an end surface 10 and an upper arc surface 11 continue by a curved surface 11*a* in a smooth convex shape, as shown in FIG. 13A, density of this portion is easily improved. The curved surface 11*a* is formed by a curved surface 31*a* formed from an upper punch arc surface 31 of the upper punch 3 to an end surface 30 of the upper punch 3, as shown in FIG. 13B.

In a compact 1D of this third embodiment, volume of a compact which forms a smooth curved surface 11*a* having radius of 1 mm is 6188 $mm^3$, and volume ratio to volume (6283 $mm^3$) of a target cylinder is 0.985 and is high. In addition, in the compact 1C of the above second embodiment, a volume of a compact that forms a smooth curved surface 11*a* having a radius of 1 mm is 6142 $mm^3$, and a volume ratio to volume (6283 $mm^3$) of a target cylinder is 0.977 and is high.

According to the present invention, a substantially cylindrical powder compact, in which there is no neutral zone, machining is unnecessary, and a cross section shape of the compact intact approximates a circle, can be provided, and as a result, such powder compacts can be produced at low cost. Therefore, the powder compact of the present invention is preferably applied to various cylindrical parts, in particular, a powder magnetic core for an iron core.

EXPLANATION OF REFERENCE SYMBOLS

1B, 1C, 1D . . . powder compact,
10 . . . end surface of compact,
11 . . . upper arc surface,
12 . . . lower arc surface,
12*a* . . . center lower arc surface,
12*b* . . . side lower arc surface,
14 . . . side flat portion,
15 . . . side edge,
15*a* . . . curved edge portion,
15*b* . . . inside edge portion of side edge,
15*c* . . . outside edge portion of side edge,
16 . . . chamfer portion,
2 . . . die,
21 . . . die hole,
22 . . . step,
24*a* . . . large width portion,
24*b* . . . small width portion,
26 . . . curved surface portion of die hole
3 . . . upper punch,
30 . . . end surface of upper punch,
31 . . . upper punch surface,
35 . . . flat portion,
35*a* . . . curved surface portion of upper punch,
36 . . . curved surface portion of upper punch,
4 . . . lower punch,
42 . . . lower punch surface,
P . . . base circle

The invention claimed is:

1. A substantially cylindrical powder compact having a substantially cylindrical shape in which a cross sectional outer shape contacts with an inside of a base circle having a substantially circular shape in which a shaft center of the circular shape agrees with the center of the circle, wherein the cross sectional outer shape is constructed by at least a pair of side edge portions, which are formed on both sides which separate about 180° in a circumferential direction from each other and extend inside from the base circle, an upper arc surface, which connects between inside edges of these side edge portions and contacts with an inside of the base circle at at least a top portion, and a lower arc surface, which connects between outside edges of the side edge portions and contacts with an inside of the base circle at at least a bottom portion, and the powder compact further comprising;

a curved surface portion, which concavely curves and rises from each side edge portion to an end surface and continues to the end surface, and a chamfer portion, which planes an edge and gradually narrows from each end surface to a side surface, on both ends in a longitudinal direction of the powder compact.

2. The substantially cylindrical powder compact according to claim 1, wherein a side flat portion that continues perpendicularly to the side edge portion is formed on the side surface.

3. The substantially cylindrical powder compact according to claim 1, wherein the lower arc surface in the cross sectional outside shape is formed by a center lower arc surface which agrees with the base circle, and side lower arc surfaces which are formed on both sides of a center lower arc surface by steps formed between the center lower arc surface and the side lower arc surface.

4. The substantially cylindrical powder compact according to claim 1, wherein a width of the side edge portion is 0.1 to 0.5 mm, the curved surface portion has at least an arc surface, an elliptical arc surface, a plane surface, or a surface that is a combination of these surfaces, a length of the curved surface portion is 1 to 5 mm, a height of the curved surface portion from the side edge portion is 1 to 5 mm, a length of the chamfer portion is longer than or equal to the length of the curved surface portion, and is less than or equal to a length of 2 mm plus the length of the curved surface portion, and a projection image of the curved surface portion to the end surface does not protrude outside from the base circle.

5. The substantially cylindrical powder compact according to claim 2, wherein a height of the side flat portion is greater than 0 mm but is 2 mm or less.

6. The substantially cylindrical powder compact according to claim 3, wherein a width of the center lower arc surface is 40 to 80% of diameter of the base circle and a height of the steps is greater than 0 mm but is 1 mm or less.

7. A powder die assembly in which a powder compact having substantially cylindrical shape is compressed by pressing in a direction crossing an axial direction at right angles, comprising:

a die, which penetrates in a vertical direction and in which a plane view is substantially rectangular, with a die hole comprising a step portion formed at an intermediate in a vertical direction, in which a cross sectional shape is a concave arc which approximates a base circle in which a shaft center of the compact agrees with the center of the circle, a large width portion formed on an upside of the step portion, in which a dimension in a width direction is relatively large, a small width portion formed on a downside of the step portion, in which a dimension in a width direction is smaller than that of the large width portion, and a curved portion formed on both sides in a longitudinal direction, in which width gradually narrows as the end surface is closed;

a lower punch, which is slidably inserted into the small width portion of the die hole, and in which a concave arc lower punch surface having a cross sectional shape in a width direction approximates the base circle, is formed on an upper end surface; and an upper punch, which is slidably inserted into the large width portion of the die hole, and in which a concave arc upper punch surface having a cross sectional shape in a width direction which agrees or approximates the base circle, is formed on a lower end surface, wherein the upper punch comprises:

a flat portion formed on both edge portions in a width direction of the lower end surface, which extends in a longitudinal direction crossing a vertical direction at right angles, a curved surface formed on both end portions in a longitudinal direction, in which height is gradually decreased while curving from a lower end surface side between the flat portion and the end surface, and a curved surface portion corresponding to the curved surface of the die.

8. The powder die assembly according to claim 7, wherein a width of the flat portion is 0.1 to 0.5 mm, the curved surface has at least an arc surface, an elliptical arc surface, a plane surface, or a surface that is a combination of these surfaces, a length of the curved surface portion is 1 to 5 mm, a height of the curved surface portion from the flat portion is 1 to 5 mm, the length of the curved surface portion is longer than or equal to a length of the curved surface, and it is less than or equal to a length of 2 mm plus than the length of the curved surface, and a projection image of the curved surface to the end surface does not protrude outside from the base circle.

* * * * *